United States Patent [19]

Phillips et al.

[11] 4,266,358

[45] May 12, 1981

[54] UNDERWATER FIREARM

[76] Inventors: John C. Phillips, 3148 S. 48th St., Phoenix, Ariz. 85040; Michael D. Nobel, 3525 E. Montecito Ave., #3, Phoenix, Ariz. 85018

[21] Appl. No.: 4,548

[22] Filed: Jan. 18, 1979

[51] Int. Cl.[3] ..... F41C 9/06

[52] U.S. Cl. ..... 42/39.5; 42/1 L

[58] Field of Search ..... 42/1 L, 14, 15, 39.5; 89/155

[56] References Cited

U.S. PATENT DOCUMENTS

| | | | |
|---|---|---|---|
| 3,417,719 | 12/1968 | Nitenson | 42/1 L |
| 3,453,763 | 7/1969 | Barr et al. | 42/1 L |
| 3,616,561 | 11/1971 | Hendricks | 42/1 L |
| 4,122,621 | 10/1978 | Barr | 42/1 L |

FOREIGN PATENT DOCUMENTS

| | | | |
|---|---|---|---|
| 68919 | 6/1915 | Austria | 42/39.5 |
| 73513 | 8/1944 | Czechoslovakia | 42/39.5 |

*Primary Examiner*—Charles T. Jordan

*Attorney, Agent, or Firm*—Cahill, Sutton & Thomas

[57] ABSTRACT

An underwater firearm for discharging self-propelled projectiles incorporates a swing arm for simultaneously loading a projectile from a magazine into the firing chamber and cocking the firing pin. Guide means in the firing chamber automatically engages a fracturable flange on loading of the projectile to retain the projectile until discharge of the firearm.

16 Claims, 11 Drawing Figures

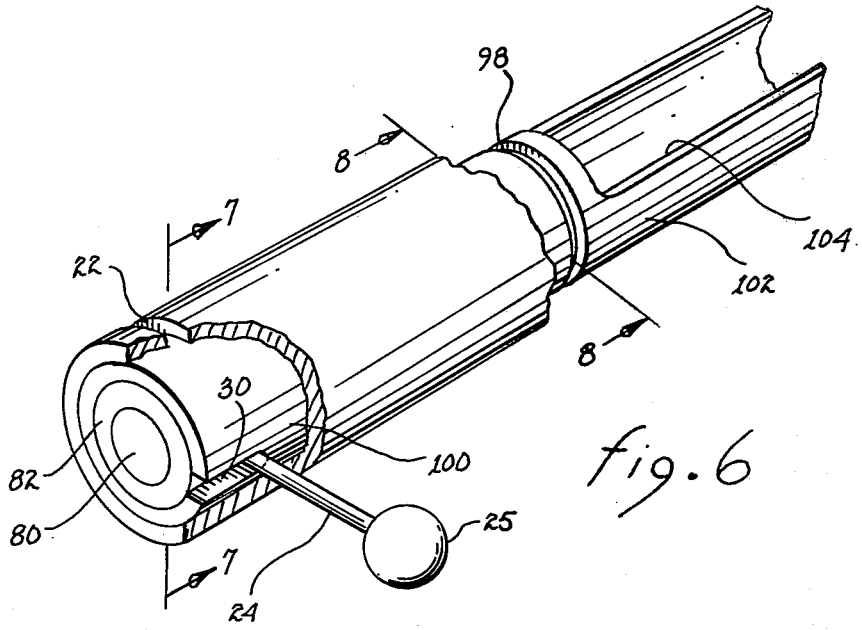
fig. 6
fig. 7
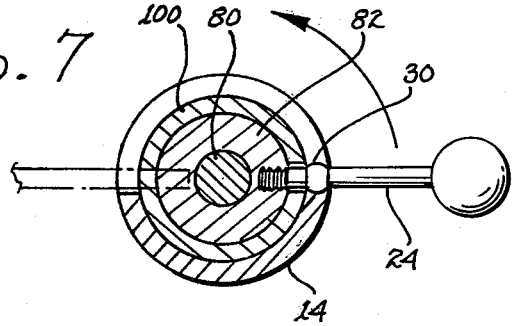
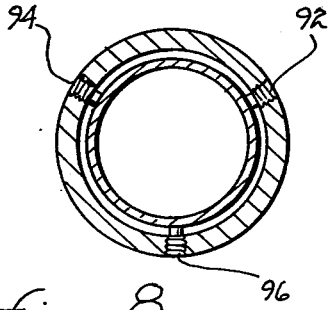
fig. 8
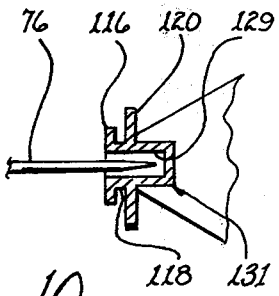
fig. 10

UNDERWATER FIREARM

The present invention relates to firearms and, more particularly, to underwater firearms.

Much of the recently accelerated work in oceanography, marine biology and underwater exploration requires the use of divers wearing various forms of self-contained underwater breathing apparatus. These divers, particularly when in ocean waters, are in danger of physical harm from various carnivorous fish, such as sharks and barracudas. Additionally, the navies, coastguards and merchant marines of the world suffer shipwrecks which force seamen into the water subject to attack by various fish. Aircraft, whether military or civilian, which overfly large seas or oceans sometimes go down in the water and subject the pilots, crew members and passengers to physical danger from fish.

Without some means of either discouraging the presence of fish which will attack humans or killing such fish if they come too close, the survival rate is very very low. In the past, various repellents have been used which repellents constitute a chemical distasteful or hurtful to the fish. Such chemicals, however, usually rapidly dissipate because of the natural water movement. Knives and similar implements are quite effective when properly used but the skill required is generally beyond that of most persons; hence, their effectiveness is very limited.

In recent years, various explosive devices have been developed which can severely or mortally injure the fish. One type of such a device incorporates an explosive shell mounted at the end of a long handle. Operation is effected by jabbing the fish with the handle to make contact between the fish and the explosive shell. On contact, a firing pin is released to impact the explosive shell and discharge it. When properly used, such a device is quite effective. The following U.S. Letters Patent illustrate various firearms of this type: U.S. Pat. Nos. 3,145,494, 3,210,877, 3,300,888, 3,580,172, 3,664,052, 3,721,031, 3,545,117, 3,553,876 and 3,747,247. Unfortunately, these devices have two main disadvantages. First, the handles, if long enough to keep the fish at bay, are difficult to maneuver under water. Second, most of the devices have a single shot and must be reloaded should the first explosion be ineffective or if several fish threaten; and, reloading is time consuming and difficult to do under the stress of the situation. U.S. Pat. No. 3,494,060 illustrates a device of this type which has multiple charges but the maneuvering difficulties still exist and a cylinder containing the charges must be sequentially rotated for each charge.

Various pistol or pistol-like devices for discharging a projectile have also been developed. U.S. Pat. Nos. 3,274,936 and 3,509,862 are directed to firearms which discharge spears, that may or may not incorporate explosive spear heads. Because of the necessary length of these firearms due to the spears, they are difficult to maneuver under water and evasion by the fish is not too difficult. U.S. Pat. Nos. 3,417,719 and 3,729,853 are directed to pistol-like firearms for discharging projectiles. These firearms are relatively easy to maneuver under water but they require the operation of a number of levers and the like to effect discharge of the projectile. Such maneuvering operations are difficult, at best, to perform under stress and their usefullness in a frenzied situation is open to question.

It is therefore a primary object of the present invention to provide a compact easily maneuverable and operable underwater firearm.

Another object of the present invention is to provide an underwater firearm having a one step operation for loading and cocking the firearm.

Yet another object of the present invention is to provide a swing arm for simultaneously loading and cocking an underwater firearm.

Still another object of the present invention is to provide a means for releasably retaining a projectile within the barrel of an underwater firearm.

A further object of the present invention is to provide a safety trigger for an underwater firearm.

A yet further object of the present invention is to provide a rotatable and axially translatable sleeve for loading a projectile and cocking the firing pin.

A still further object of the present invention is to provide a simplified inexpensive underwater firearm for discharging self-propelled projectiles.

A still further object of the present invention is to provide a self-propelled projectile for underwater guns.

A still further object of the present invention is to provide a quick release magazine for underwater firearms.

These and other objects of the present invention will become apparent to those skilled in the art as the description thereof proceeds.

The present invention will be described with greater specificty and clarity with reference to the following drawings, in which:

FIG. 6 is a partial view of the barrel;

FIG. 7 is a cross-sectional view taken along lines 7—7, as shown in FIG. 6;

FIG. 8 is a cross-sectional view taken along lines 8—8, as shown in FIG. 6;

FIG. 10 is a partial cross-sectional view of the projectile retaining flange.

To be effective, an underwater firearm must embody several features. First, it must be relatively easily maneuverable despite the resistance presented by the water. Second, discharge of the firearm must be convenient and fail safe. Third, loading and cocking of the firearm must be simple and positive. Fourth, multiple projectiles must be dischargeable at a rapid rate. And, 5th, replacement of the projectile magazine must be simple and quick. As will become apparent from the description below, the underwater firearm described and illustrated herein satisfies all of these criteria.

Figure 1:
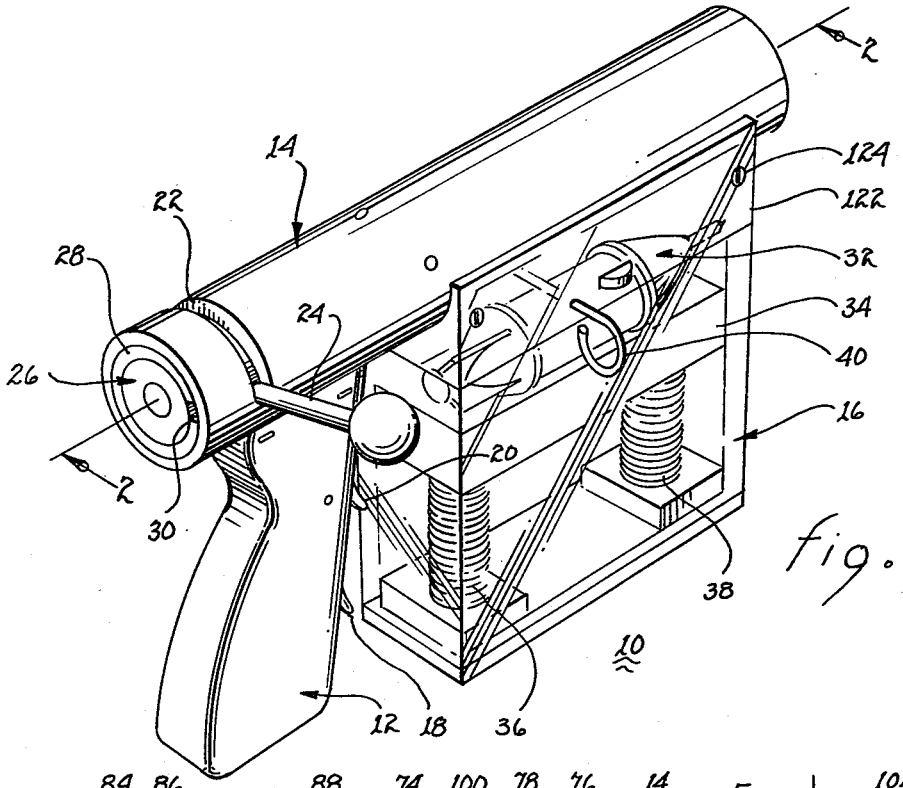
FIG. 1 is a perspective view of an underwater firearm.
Figure 2:
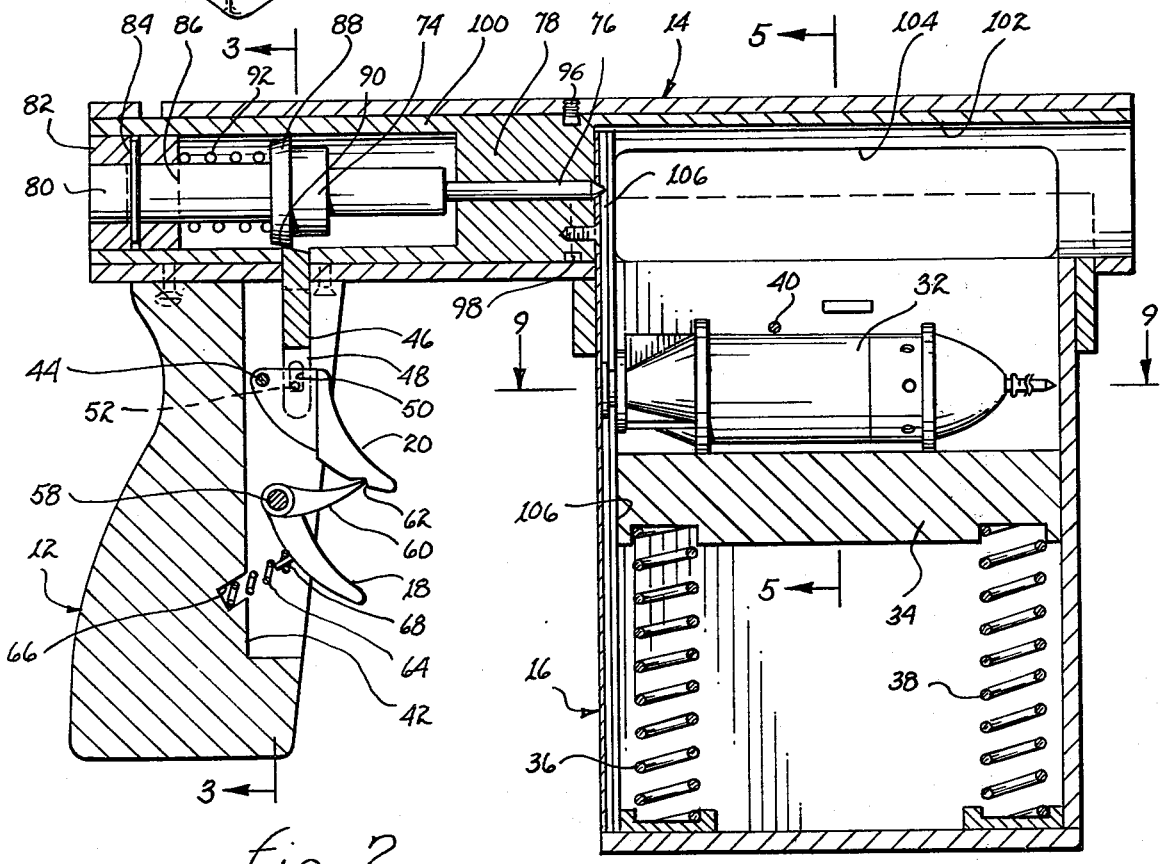
FIG. 2 is a cross-sectional view taken along lines 2—2, as shown in FIG. 1.
Figure 3:
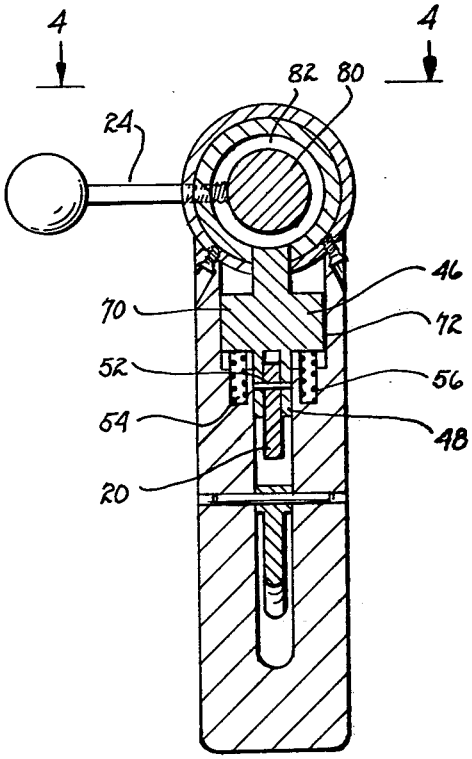
FIG. 3 is a cross-sectional view taken along lines 3—3, as shown in FIG. 2.
Figure 4:
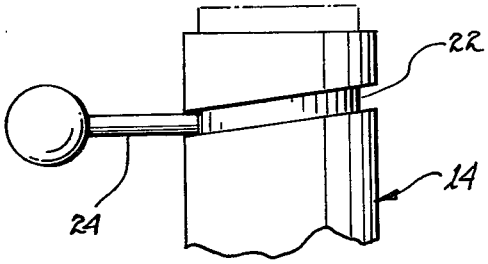
FIG. 4 is a partial view of the top rear of the firearm.
Figure 5:
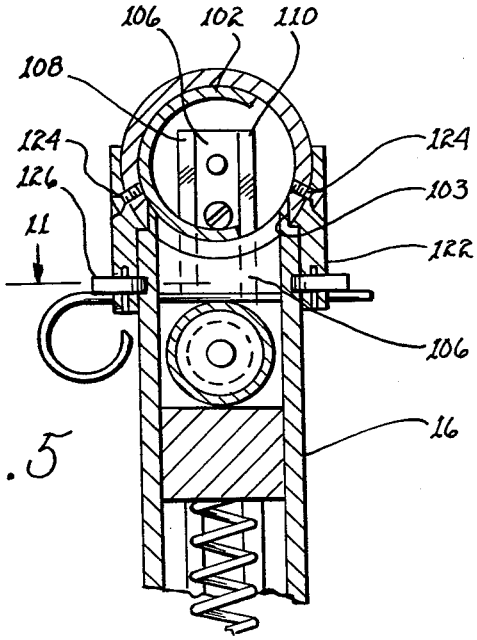
FIG. 5 is a cross-sectional view taken along lines 5—5, as shown in FIG. 2.
Figure 11:
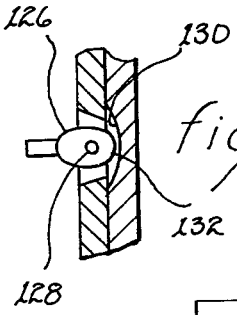
FIG. 11 is a partial cross-sectional view of the magazine locking mechanism.
Figure 9:
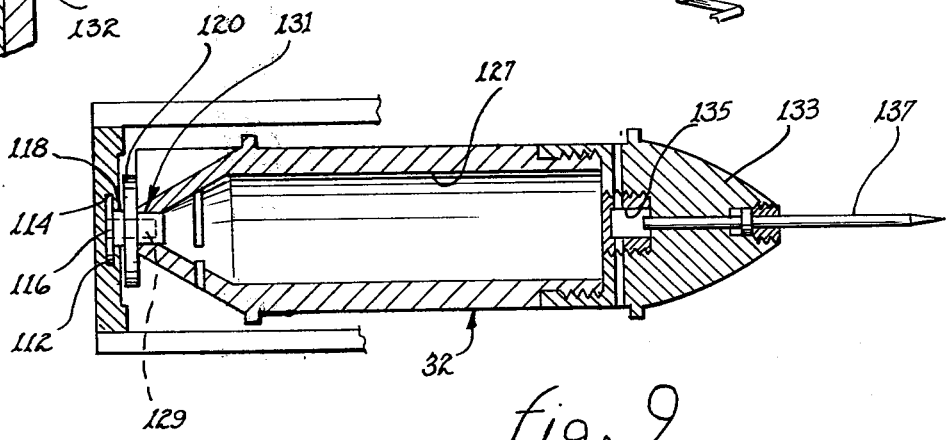
FIG. 9 is a cross-sectional view taken along lines 9—9, as shown in FIG. 2.

Referring to FIG. 1, there is shown a firearm 10 having a handle 12 supporting a barrel 14. A magazine 16 is dependingly attached to the barrel. Handle 12 is in the shape of a pistol grip and includes a safety trigger 18 and a trigger 20 for releasing a cocked firing pin. A slot 22 is disposed within barrel 14, which slot is skewed with respect to the longitudinal and lateral axis of the barrel. A swing arm 24, having a knob 25 attached to the end is secured to a bolt or firing pin cocking mechanism 26 internal to barrel 14 and extends through slot 22. Angular movement of swing arm 24, resulting in rotation of mechanism 26 about the longitudinal axis of barrel 14 produces, because of the orientation of slot 22, translatory movement of the mechanism along the longitudinal axis of the barrel. A cylindrical sleeve 28, internal to barrel 14, engages swing arm 24 by means of a longitudinally oriented slot 30 such that pivotal movement of the swing arm results in commensurate angular reorientation of the sleeve within the barrel. As will be discussed in further detail below, sleeve 28 includes an aperture through which projectiles 32 within magazine 16 are sequentially loaded into the firing chamber of barrel 14 for discharge.

Magazine 16 is preferably made of transparent material in order to provide an immediately apparent visual indication of the number of projectiles 32 still remaining. The projectiles are supported within the magazine upon a platform 34. The platform is supported upon springs 36 and 38 internal to the magazine and provide the force necessary to force projectiles 32 from the magazine into the firing chamber of the barrel. During attachment and detachment of magazine 16, the projectiles must be maintained therein. A removable pin 40, penetrably engaging apertures in opposed sides of the magazine and located in proximity to the top of the magazine, serves as a guard to preclude unwanted ejection of the projectiles in response to the force exerted by springs 36 and 38.

Referring jointly to FIGS. 1–8, the operative mechanisms embodied within handle 12 and barrel 14 will be described. Handle 12 is configured as a conventional pistol grip and includes forwardly facing triggers 18 and 20. A slot 42 is disposed in the forward side of the handle to receive the triggers. Trigger 20, is pivotally pinned within the slot by a pin 44. A sear release 46, extending upwardly from trigger 20, is connected to the trigger through a clevis 48 having elongated slots 50 for receiving pin 52. Springs 54 and 56, disposed within cavities in the handle, exert an upward force upon sear release 46. Sear release 46 includes two laterally extending wings 70 and 72. These wings serve as a convenient bearing surface for spring 54 and 56. By slidably mounting the wings within slots, rotation of the sear release about its axis of travel is precluded. To prevent inadvertent actuation of the firearm by operation of trigger 20, safety trigger 18 is employed. This trigger is pivotally supported within slot 42 by pin 58. Trigger 18 includes an angularly offset pawl 60, which pawl is engageable with notch 62 in trigger 20. The pawl is biased toward trigger 20 by means of a spring 64 located within cavity 66 to bear against the rear surface of trigger 18 and maintained in place by protrusion 68.

In operation, downward pivotal movement of trigger 20 is precluded by interference with pawl 60. To release trigger 20, safety trigger 18 must be depressed to bring the tip of pawl 60 out of registration with notch 62. Thereafter, trigger 20 may be actuated to lower sear release 46.

It is to be understood that slot 42 could readily be replaced with a slot having a Tee-shaped cross-section, which modified slot would receive a preassembled trigger assembly and sear release insertable from the bottom of the handle.

A member 78 is retained within barrel 14 by means of bolts 92, 94 and 96 equiangularly spaced about and in threaded engagement with barrel 14. These bolts slidably mate with annular channel 98 disposed in member 78. Thereby, axial movement of member 78 with respect to barrel 14 is precluded yet relative rotation therebetween about the respective longitudinal axis is possible. Bolt 74, supporting firing pin 76 journaled within member 78, includes a shaft 80 slidably mounted within a collar 82. The shaft is attached to the collar by a pin 84 disposed within a slot 86 extending through the shaft whereby limited axial translation of bolt 74 with respect to collar 82 is possible. An annular flange 88 is disposed about bolt 74 for engagement with sear 90 of sear release 46, the contacting surface of the flange and sear are angled to preclude immovable interference therebetween. A spring 92 is disposed intermediate collar 82 and flange 88 to bias bolt 74 away from collar 82.

Cocking of the firearm is effected as follows. Swing arm 24 is rotated counterclockwise (as viewed from the rear) with respect to barrel 14 to the extremity of slot 22 and thereafter returned. As the swing arm is in threaded engagement with collar 82, and as slot 22 is skewed with respect to the longitudinal and lateral axis of the barrel, counterclockwise rotation of the swing arm results in rearward movement of the collar. Such rearward movement draws bolt 74 rearwardly by pin 84 engaging the rear edge of slot 86. On rearward movement of bolt 74, flange 88 will be located rearwardly of sear 90 and sear release 46 will be free to travel upwardly under force of springs 54 and 56 until the upper edges of wings 70 and 72 are restrained from further upward movement by interference with barrel 14 or other stop. After the flange passes the sear, the sear release will be forced upwardly by springs 54 and 56 acting thereupon. Upon movement of swing arm 24 in a clockwise direction (as viewed from the rear), collar 82 is translated forwardly. Forward translation of the collar pushes spring 92 forwardly, which spring in turn bears against the rear face of flange 88 to urge bolt 74 forwardly. Such forward movement of the bolt will be prevented by interference between sear 90 and flange 88. Thus, further forward movement of the collar results in compression of spring 92.

On actuation of trigger 20, after release thereof through operation of safety trigger 18, sear release 46 is drawn downwardly and upon such downward movement, sear 90 will clear the lateral edge of the flange and unlock the bolt from its cocked position. Upon unlocking, spring 92 will urge bolt 74 and attached firing pin 76 forwardly to strike and discharge a projectile loaded within the firing chamber of barrel 14.

As particularly illustrated in FIGS. 1, 6 and 7, skirt portion 100 of member 78 includes a rearwardly opening slot 30 through which swing arm 24 extends. This slot ensures rotation of member 78 commensurate with movement of swing arm 24 yet translation of the swing arm along the longitudinal axis of barrel 14 will not produce a commensurate translation of the skirt.

The mechanisms for loading and unloading projectiles 32 will be described with particular reference to FIGS. 2, 5, 6, 8, 9 and 10. An inner sleeve 102 may be developed as an apertured cylindrical projection of the peripheral surface of member 78; in the alternative, it may be developed distinct to member 78 and attached thereto by any one of several conventional means. Inner sleeve 102 serves the function of receiving, on command, a single one of projectiles 32 and enclosing the projectile within a firing chamber prior to release of cocked firing pin 76. An opening 103 (see FIG. 5) is disposed within the under surface of barrel 14 commensurate with the opening of attached magazine 16. Inner sleeve 102, includes an aperture 104, which aperture is generally coincident with opening 103 in barrel 14. As inner sleeve 102 is rotatable, the aperture in the sleeve serves as a gate for admitting a single projectile and thereafter on rotation of the sleeve, the sleeve closes opening 103 in the barrel. As is evident from FIG. 7, swing arm 24 is positionable through an angle of approximately 180°. Accordingly, inner sleeve 102 is rotatable through a similar angle. Since the clockwise most position of the swing arm (when viewed from the rear) is the firing position for the firearm, opening 103 should be closed by inner sleeve 102 when the swing arm is so positioned. Thus, for the position of the swing arm as shown in FIG. 7, aperture 104 in sleeve 102 is adjacent the upper half of the inner surface of barrel 14. When inner sleeve 102 is rotated approximately 180° by actuation of swing arm 24, aperture 104 becomes located commensurate with opening 103 at which position a fresh projectile 32 can be inserted within the firing chamber in barrel 14 under force of springs 36 and 38 in magazine 16. It may be noted that in FIG. 2, aperture 104 is approximately midway between the top and bottom inner surface of barrel 14.

By inspection, it becomes apparent that upon actuation of swing arm 24 through one cycle, bolt 74 becomes cocked on completion of movement in the counterclockwise direction and at the end of travel in this direction, aperture 104 is in alignment with magazine 16 to allow projectile 32 to enter the firing chamber within barrel 14. Upon clockwise movement of the swing arm, opening 103 in the barrel is progressively closed and complete closure is effected upon return of swing arm 24 to its starting position. Thus, a simple and rapidly performable movement of swing arm 24 cocks and loads the firearm.

To ensure retention of projectile 32 within the firing chamber, a guideway 106 is disposed at the forward face of member 78. This guideway includes two opposed ledges 108 and 110 defining lateral slots 112 and 114 (see FIG. 9). Necessarily, guideway 106 rotates commensurate with rotation of member 78 and inner sleeve 102. Magazine 16 includes an extension of the guideway, also identified by reference numeral 106. When inner sleeve 102 is rotated by means of swing arm 24 to the position for loading a projectile 32, both guideways are in alignment with one another (see also FIG. 5).

Projectile 32 includes a disc 116 mounted upon a hollow stud 118, which disc is dimensionally commensurate with slots 112 and 114 to allow translation of the disc along guideway 106. Thereby the guideway guides the projectile from the magazine into the firing chamber. Once in the firing chamber, the projectile is prevented from sliding out of the barrel. On discharge of the projectile, disc 116 will fracture and thereby release the projectile from the guideway. Necessarily, the strength of the disc must be sufficient to maintain the projectile within the barrel and yet allow fracturing to occur upon discharge. To further aid translation of projectile 32 within guideway 106, an annular flange 120 may be incorporated to bear against the adjacent surfaces of ledges 112 and 114.

Referring jointly to FIGS. 1, 2, 5, 9 and 11, additional details of magazine 16 will be described. A depending rectangular shroud 122 is attached to the lower lateral surface of barrel 14 by means such as machine screws 124. This shroud is dimensioned to internally receive the upper edges of magazine 16 and provide structural support therefore. The magazine is locked to shroud 122 by means such as finger operated cams 126 pivotally mounted upon pins 128 in opposed sides of the shroud. Each cam 126 mates with a closely dimensioned groove 130 in the magazine. Thus, by rotation of cam 126, lobe 132 of the cam is brought into and out of engagement with groove 130. When in engagement, the magazine is locked to the shroud. It may be noted that the magazine may be unlocked or locked by passing ones hand across both cams simultaneously and slidingly engaging the cams to effect rotation thereof about their respective pins.

Projectile 32 will be described with greater specificity with reference to FIGS. 1, 2, 9 and 10. The projectile is a self-propelled projectile having a chamber 127 for containing a propellant. The propellant is ignited by an igniter cap or similar element disposed within a cavity 129 of insert 131. This cap is ignited by firing pin 76 and, upon ignition, ignites the propellant. Projectile war head 133, which may be threadably disengageable from the body, as indicated, may include an explosive ignited by a cap disposed in cavity 135. A sensor or probe 137 extending forwardly of the war head is slidably mounted therein such that rearward movment of the probe will occur upon impact with a target. Such rearward movement will ignite the cap within probe 137 and detonate the explosive material within the war head.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. A firearm for discharging projectiles, said firearm comprising in combination:

(a) a barrel for discharging a projectile, said barrel having a longitudinal axis and including a firing chamber and an opening for lateral insertion of the projectile into said firing chamber to load said firearm;

(b) means for retaining the projectile within said firing chamber until discharge of the projectile or unloading of said firearm;

(c) an inner sleeve rotatably mounted within said barrel for closing said opening on rotation of said inner sleeve, said inner sleeve including an aperture configured commensurate with said opening to accommodate admission therethrough of the projectile;

(d) a mechanism for actuating a firing pin to discharge a projectile;

(e) a swing arm pivotable through an arc about the longitudinal axis of said barrel for cocking said mechanism and simultaneously rotating said inner sleeve to admit and enclose a projectile within said firing chamber; and (f) trigger means for triggering said mechanism to actuate the firing pin and discharge a projectile.

2. The firearm as set forth in claim 1 including a magazine for sequentially injecting each of a plurality of projectiles into said firing chamber.

3. The firearm as set forth in claim 2 further including quick release means for detachably attaching said magazine to said barrel.

4. The firearm as set forth in claim 3 wherein said quick release means comprises cam means having lobes for engaging slots disposed in said magazine.

5. The firearm as set forth in claim 1 wherein said retaining means comprises a guideway located within said firing chamber for retaining engagement with each projectile.

6. The firearm as set forth in claim 5 wherein each projectile includes a disc attached to the projectile for engaging said guideway.

7. The firearm as set forth in claim 6 including a magazine for sequentially injecting each of a plurality of projectiles into said firing chamber, said magazine including a further guideway for guiding the projectiles from said magazine into said firing chamber for engagement with said guideway.

8. The firearm as set forth in claim 1 wherein said mechanism comprises an axially translatable bolt disposed within said barrel and supporting the firing pin, said bolt including a shaft, a spring and a rotatable collar for supporting said swing arm, said collar being mounted upon said shaft for drawing said bolt against said spring to a cocked position, sear means for retaining said bolt in the cocked position, a slot disposed within said barrel for guiding said swing arm to translate said collar in a first direction along the longitudinal axis of said barrel during arcuate movement of said swing arm in a first direction and to translate said collar in a second direction along the longitudinal axis of said barrel during arcuate movement of said swing arm in a second direction.

9. The firearm as set forth in claim 8 wherein said inner sleeve includes a slot for receiving said swing arm to impart arcuate motion of said swing arm into rotational motion of said sleeve.

10. The firearm as set forth in claim 9 wherein said collar includes a pin extending across said collar and said shaft includes a slot for receiving said pin, whereby said slot affords limited axial movement between said shaft and said collar.

11. The firearm as set forth in claim 10 wherein said bolt includes an annular flange for engagement with said sear.

12. The firearm as set forth in claim 11 wherein said spring is disposed intermediate said collar and said annular flange.

13. The firearm as set forth in claim 1 wherein said trigger means comprises a trigger, a sear release responsive to said trigger and a safety trigger for preventing operation of said trigger.

14. The firearm as set forth in claim 13 wherein said safety trigger includes a pawl for lockingly engaging said trigger.

15. The firearm as set forth in claim 1 wherein the projectile comprises a self propelled projectile.

16. The firearm as set forth in claim 15 wherein said self propelled projectile includes an explosive warhead.

* * * * *